United States Patent [19]

Reiss

[11] Patent Number: 4,574,392

[45] Date of Patent: Mar. 4, 1986

[54] ARRANGEMENT FOR THE TRANSMISSION OF SPEECH ACCORDING TO THE CHANNEL VOCODER PRINCIPLE

[75] Inventor: Ruediger Reiss, Haar, Fed. Rep. of Germany

[73] Assignee: Siemens Aktiengesellschaft, Berlin & Munich, Fed. Rep. of Germany

[21] Appl. No.: 400,958

[22] Filed: Jul. 22, 1982

[30] Foreign Application Priority Data

Sep. 22, 1981 [DE] Fed. Rep. of Germany ..... 3137679

[51] Int. Cl.[4] ..... G10L 1/00

[52] U.S. Cl. ..... 381/51

[58] Field of Search ..... 381/51-53; 364/724

[56] References Cited

U.S. PATENT DOCUMENTS

| | | | |
|---|---|---|---|
| 4,377,793 | 3/1983 | Horna | 364/724 |
| 4,389,540 | 6/1983 | Nakamura | 364/724 |
| 4,456,893 | 6/1984 | Otani | 364/724 |

OTHER PUBLICATIONS

Freeny, "Special Purpose Hardware for Digital Filtering", Proc. IEEE, Apr. 1975, pp. 633-637.

Flanagan: "Speech Analysis, Synthesis and Perception", 2nd Ed., 1972, pp. 323-330.

Gold et al, "The Channel Vocoder", IEEE Transactions on Audio and Electroacoustics, vol. AU-15, No. 4, Dec. 4, 1967, pp. 148-158.

Gold et al, "New Applications of Channel Vocoders", IEEE Trans. on Acoustics, Speech and Signal Processing", vol. ASSP-29, No. 1, Feb. 1, 1981, pp. 13-23.

Holmes, J. N., "The JSRU Channel Vocoder", IEEE Proceedings, vol. 127, Pt. F., No. 1, Feb. 1980, pp. 53-60.

*Primary Examiner*—E. S. Matt Kemeny

*Attorney, Agent, or Firm*—Hill, Van Santen, Steadman & Simpson

[57] ABSTRACT

A synthesizer for a channel vocoder for the transmission of speech with considerable frequency band reduction in digital technology provides a reduction of circuit expense. This is accomplished, given non-recursive filters having finite impulse response, not with a weighting of the pulse-shaped excitation variable with the transmitted envelope values of the spectral channels, but with a time variance of the filters by weighting their filter coefficients with the transmitted envelope values. In addition, with proper dimensioning of the filter coefficients, an optimum speech quality of synthesized speech is obtained at the output of the synthesizer even given elimination of the transmission of a voiced/-voiceless signal.

4 Claims, 5 Drawing Figures

ARRANGEMENT FOR THE TRANSMISSION OF SPEECH ACCORDING TO THE CHANNEL VOCODER PRINCIPLE

BACKGROUND OF THE INVENTION

1. Field of the Invention

The present invention relates to an arrangement for transmitting speech, and more particularly to an arrangement for transmitting speech via a channel vocoder in which, at the transmitting side, envelope values for a plurality of spectral channels which differ with respect to frequency position and width, as determined by a filter bank, and, if necessary, additional speech-associated parameters such as base speech frequency and voice characteristic, are derived in a vocoder analyzer and combined into a digital sum signal before being transmitted to a receiving side in successive pulse frames respectively embracing a single analysis interval. The digital sum signal is again divided at the receiver into the individual spectral channels and, if necessary, into the channels assigned to the additional speech-associated parameters, and the channel signals are subsequently supplied to a receiver vocoder synthesizer which, in turn, includes a filter bank corresponding to the vocoder analyzer at the transmitting side, and a pulse generator, and which emits a generated synthetic speech signal.

2. Description of the Piror Art

Channel vocoder transmission techniques are known, for example, from the publication *IEEE Transactions on Audio and Electroacoustics*, Volume Au-15, No. 4, December 1967, pp. 148–161. As a rule, such channel vocoders make use of the same filter bank in the analysis section and in the synthesizer section, given speech transmission in half-duplex operation; a favorable expense thereby occurs because the filter bank can be respectively switched and, therefore, must be present only once per device.

The transition from analog circuits to digital circuits being continuously undertaken in the course of advancing integrated technology also leads to the exclusive realization of channel vocoders in digital technology. As demonstrated, for example, by the publication *IEEE Transactions on Acoustics, Speech and Signal Processing*, Volume ASSP-29, No. 1, February 1981, pp. 13–23, particularly at Page 16, right-hand column, paragraph 1, infinite impulse response (IIR) filters and finite impulse response (FIR) filters are mentioned for the realization of a filter bank using digital techniques. However, the expense for such filters is considerable. This is particularly true for a non-recursive filter having finite impulse response because of the high ordinal number requirement. The digital recursive filters having infinite impulse response can indeed be realized for the state of pulse with a considerably lower ordinal number, but do not have the favorable properties of the FIR filters.

So-called "Switched capacitor filters" which are available in integrated construction and make due with a low installation volume can also be employed as digital filters. However, like all sampling filters, such filters have the disadvantage that their transfer function periodically repeats in the frequency range. In other words, the input signal for such a filter may not have any spectral components above half the sampling frequency. As practice has shown, the upper limit frequency of the input signal must have an even greater spacing from half the sampling frequency if disruptions are to be avoided. No problems thereby occur regarding the analysis section, since this spacing can be observed with certainty by simple techniques. In the synthesizer section, on the other hand, this requirement cannot be met without considerable additional expense as a result of the pulse-shaped excitation function. In other words, considerable analog filter structure must be employed in order to sufficiently suppress disruptive effects in the form of a chirping background noise.

SUMMARY OF THE INVENTION

The object of the invention is to provide a digital filter bank for a synthesizer of a channel vocoder constructed in digital technology which, given a relatively low technical expense, can guarantee an optimum speech quality of the generated synthetic speech.

According to the invention, and proceeding from an arrangement for transmission of speech according to a channel vocoder principle of the type initially mentioned, the above object is achieved in that the filter banks designed in digital technology comprise non-recursive, time-variant filters having finite impulse response (FIR filters). Further, the excitation variable of the pulse generator is supplied at the input side to the filter bank with constant pulse amplitude. The time-variance of the gain of the filter bank is produced in multipliers by multiplication of the filter bank coefficients by the envelope values transmitted in the rhythm of successive frames.

The present invention proceeds from the significant perception that it is of no significance for the impulse reply of a FIR filter whether the pulse sequence applied to its input is weighted with the transmitted envelope values or whether, on the other hand, the weighting occurs over a multiplication of the filter coefficients by the transmitted envelope values. A filter bank, constructed in accordance with the present invention, as a time-variant filter bank to which the excitation variable of a pulse generator is supplied at its input side with constant amplitude reduces the multiplications to be carried out in the synthesizer and, therefore, the filter expense, in an extremely advantageous manner.

Given a first, preferred embodiment, the FIR filters to which the excitation variable is supplied at the input side respectively comprise an iterative network of $N-1$ identical time-delay stages with a maximum of N taps. Each FIR filter has a plurality of switches corresponding to the taps, whose control inputs are connected to the taps. Thereby, each switch connects the output of the multiplier to the filter output. Each multiplier has an input for the assigned transmitted envelope value and a filter coefficient is applied at respective other inputs of the multipliers, the totality of the filter coefficients fixing the filter response.

Given a second, preferred arrangement, the filter bank is a FIR sum filter which comprises an iterative network of $N-1$ identical time-delay stages with a maximum of N taps and which has a plurality of switches corresponding to the taps, whose control inputs are connected to the taps. Each switch connects the output of a multiplier sum circuit to the filter output which executes the product formation of the individual filter coefficients with the appertaining transmitted envelope values and forms the product sum.

The envelope values usually exclusively transmitted in powers of two for reasons of redundancy reduction offer the possibility of respectively executing the multiplication with the filter coefficients in a shift unit, this providing a further, significant reduction of expense.

In a further development of the invention, the execution variables supplied to the FIR filters or, respectively, to the FIR sum filter can, while foregoing the voiceless/voiced transfer, be a pulse sequence periodically generated by a pulse generator and controllable in its repetition rate by the transmitted base voice frequency value. In this context, the filter coefficients are dimensioned in such a manner that an optimum speech quality of the synthesized speech is thereby guaranteed.

A first such preferred dimension can provide that the filter coefficients of the FIR filters or, respectively, of the filter areas of the FIR sum filter are dimensioned with mean frequencies <2 kHz for pulse responses and those for the FIR filters or, respectively, the filter areas of the sum filter are dimensioned with mean frequency >2 kHz for noise responses.

A further preferred dimensioning can provide that all filter coefficients of the FIR filters are, respectively, of the FIR sum filter are dimensioned for noise responses.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

The envelope values Ai as well as the base frequency information No and a voiceless/voiced signal Sc combined at the transmission side into a time-division multiplex frame within an analysis interval are first separated into individual channels at the receiving side in a demultiplexer DEMUX to which the sum signal ss is supplied at its input side, namely into M spectral channels for M envelope values A1, A2 . . . AM, as well as the channel for the voiceless/voiced signal Sc and the channel for the base frequency information No.

The actual synthesizer ST comprises a filter bank having a plurality of band pass filters B1, B2 . . . BM to which the envelope values are respectively supplied via modulators M, M2 . . . MM. As a function of the voiceless/voiced signal Sc, the excitation variable X (n) is supplied to a second input of each modulator from a pulse generator PG or from a pseudo random pulse generator PNG via a transfer switch U. The pulses of the pulse generator PG or of the random pulse generator PNG emitted at the outputs of the modulators and weighted by the envelope values A1, A2 . . . AM are fed through the respective band pass filters B1, B2 . . . BM. The resulting filtered signals Y1 (n), Y2 (n) . . . YM (n) are then combined into a synthesized speech signal Y (n) by way of a summer SU which constitutes the output of the synthesizer ST.

Figure 1:
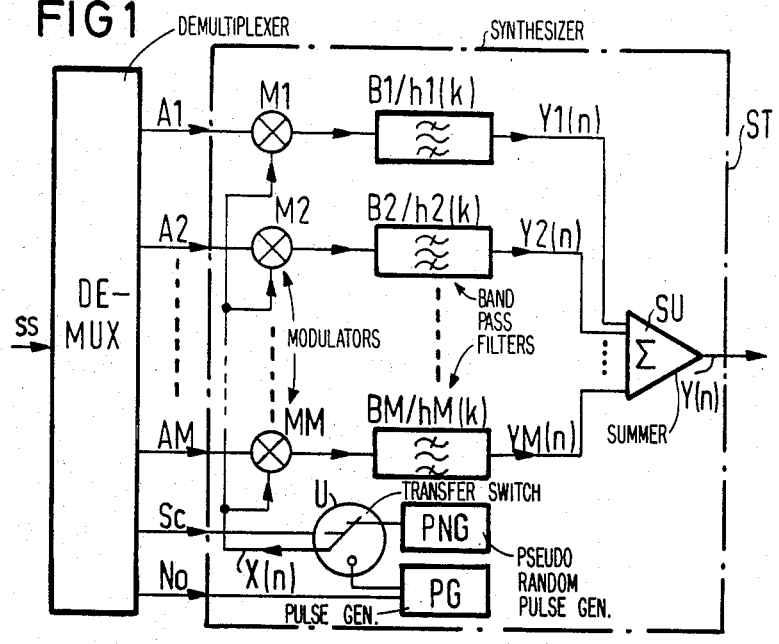
PRIOR ART FIG 1
FIG. 1 is a block circuit diagram of a synthesizer of a standard channel vocoder.

Given consideration of the filter coefficients h1 (k), h2 (k) . . . hM (k) referenced in FIG. 1 for the band pass filters, the following equation holds true for the output signal Y (n) for the execution of the band pass filters B1, B2 . . . BM as FIR filters.

$$y(n) = \sum_{i=1}^{M} Ai \sum_{k=0}^{N-1} hi(k) \cdot x(n-k) \tag{1}$$

The above is based on the fact that each of the band pass filters B1, B2 . . . Bn representing a FIR filter exhibits N taps and is selected from N−1 identical time delay elements having a delay time which is equal to the mean chronological spacing of two successive pulses. The expression in equation (1) behind the first summation symbol represents the respective filter response yi (n), so that equation (1) can also be written $$y(n) = \sum_{i=1}^{M} yi(n) \tag{2}$$

As equation (1) illustrates, the same result derives for the output signal Y (n) when, instead of a weighting of the excitation variable X (n) supplied by the pulse generator PG or, respectively, by the random pulse generator PNG with the envelope values Ai, the filter coefficients hi (k) are multiplied by the envelope values Ai.

The equation (1) for the output signal Y (n) of the synthesizer can therefore be rewritten as:

$$y(n) = \sum_{i=1}^{M} \sum_{k=0}^{N-1} Ai \cdot hi(k) \cdot x(n-k) \tag{3}$$

When $Ai \cdot hi(k) = gi(k)$ is introduced for the product $Ai \cdot hi(k)$, there then follows $$y(n) = \sum_{i=1}^{M} \sum_{k=0}^{N-1} gi(k) \cdot x(n-k) \tag{4}$$

The expression appearing behind the first summation isignal again represents the output function yi (n) of an individual filter, so that the expression $$y(n) = \sum_{i=1}^{M} yi(n) \tag{5}$$

also holds true here.

Figure 2:
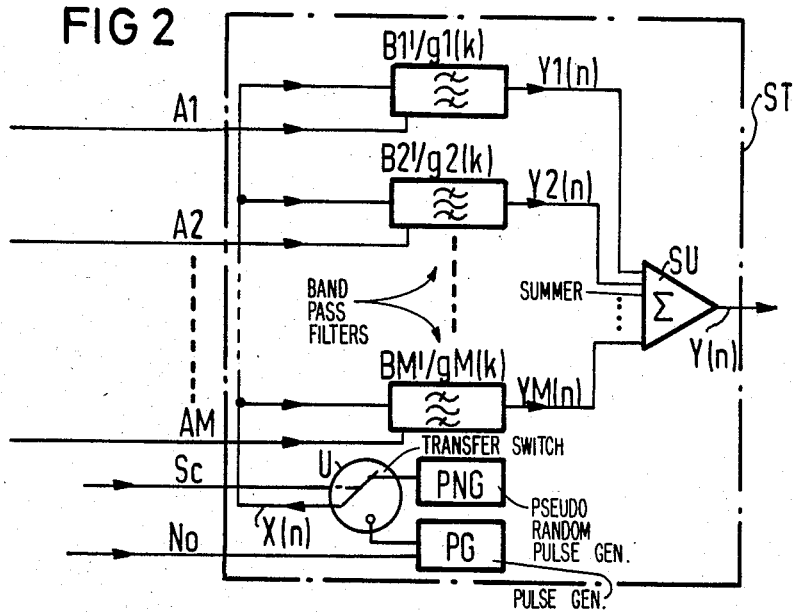
FIG. 2 is a block diagram of a synthesizer constructed in accordance with the present invention and corresponding to the synthesizer of FIG. 1.

The synthesizer ST realizing the equations (3)–(5) and constructed with FIR filters is illustrated in FIG. 2. The band pass filters B1', B2' . . . BM' representing the time-variant FIR filters now replace the time-variant band pass filters B1, B2 . . . BM of FIG. 1. The excitation variable X(n) is here directly supplied to the inputs of the band pass filters in the form of a pulse sequence having a constant pulse amplitude. The time variance of the filters is controlled via the envelope values A1, A2 . . . AM in that they weight the filter coefficients hi (k) by forming the products gi (k). The weighting must occur once for each filter for each incoming frame of the sum signal ss.

Figure 3:
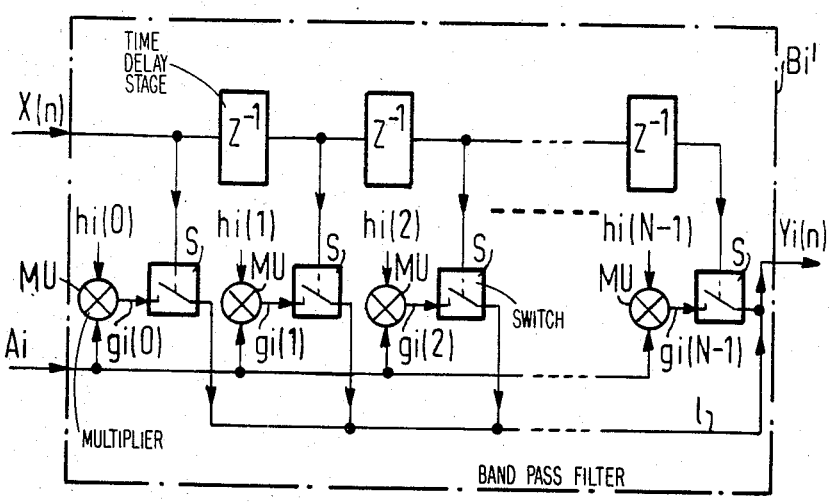
FIG. 3 is a block circuit diagram of a digital bandpass filter of the synthesizer of FIG. 2.

A band pass filter Bi' in the form of such a time-variant FIR filter is illustrated in FIG. 3. The filter comprises N−1 identical time delay stages $Z^{-1}$ connected in series and N taps. The N taps are connected to control inputs N switches which respectively connect the output of a multiplier MU to a sum line 1 supplying the filter response yi (n). The appertaining envelope value Ai is supplied to each multiplier MU assigned to a switch S, the value being supplied to its one input. The filter coefficients hi (0), hi (1) . . . hi (N−1) are applied at the N second inputs of the N multipliers MU. The only function of the excitation variable X (n) supplied to the input of the chain of time delay elements within the filter is a control of the switches S to "open" or "close", depending whether no pulse occurs or a pulse occurs. This has become possible since the execution variable itself is no longer weighted by the envelope values. The transition from time-invariant to time-variant FIR filters therefore enables Mm multipliers to be saved. As already mentioned, the multipliers can be executed in an extraordinarily simple manner as shift units because, for reasons of redundancy reduction, the transmitted envelope values can only exhibit values which are either zero or powers of two.

Figure 4:
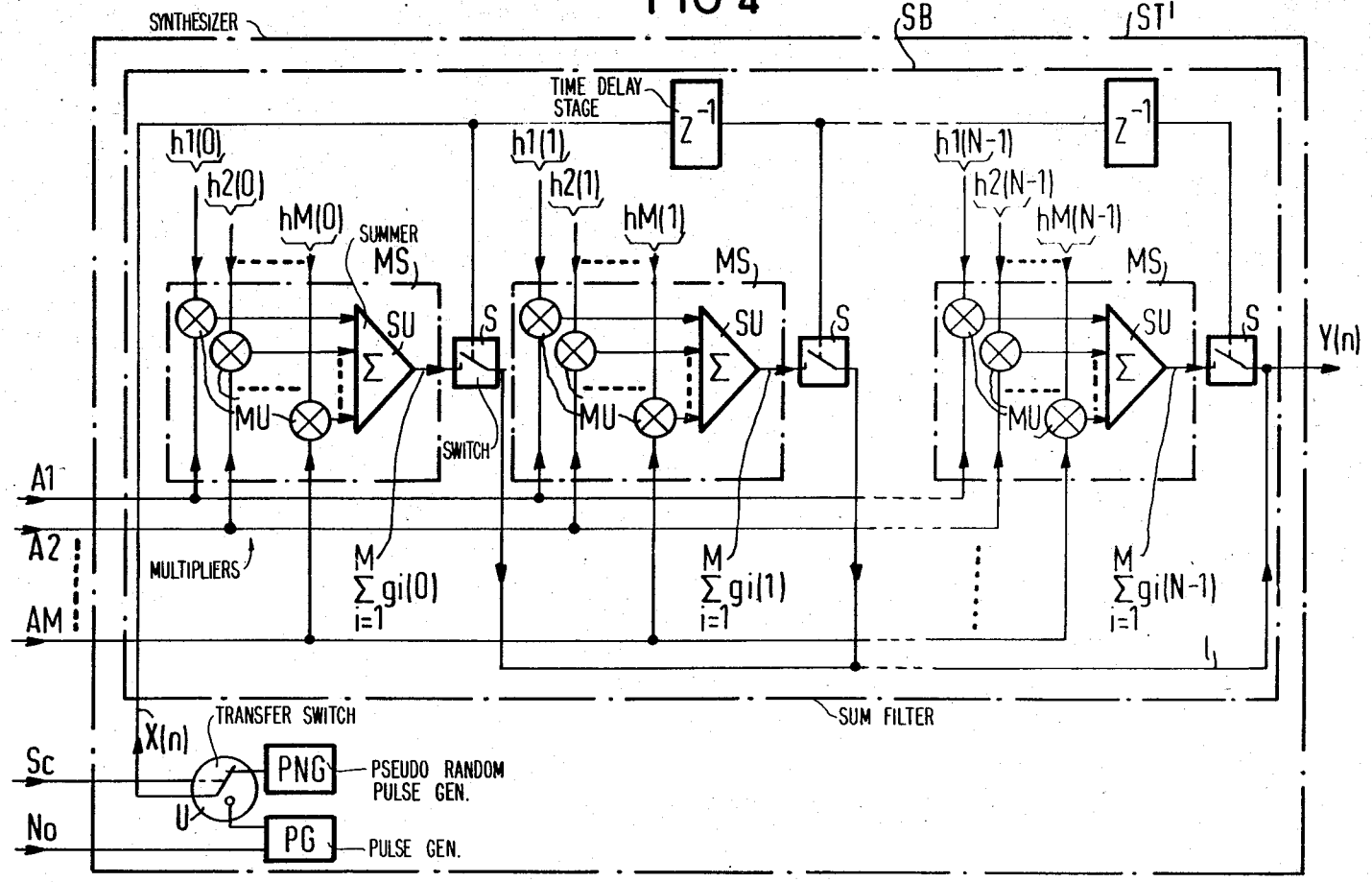
FIG. 4 is a schematic representation of another embodiment of a synthesizer having a digital sum filter constructed in accordance with the present invention.

FIG. 4 illustrates an embodiment of the synthesizer ST according to FIG. 2 in which the band pass filters B1', B2' . . . BM' are combined into a single sum filter SB. In accordance with FIG. 4, the sum filter SB of the synthesizer ST' again exhibits the iterative network of N identical time delay stages $Z^{-1}$ having N taps which are respectively connected to the control inputs of respective N switches S. Differing from the individual filters according to FIG. 3, the multiplier/sum arrangement MS which respectively exhibits M multipliers is provided here instead of a single multiplier. The outputs of the M multipliers are connected to the appertaining switch S via a summer SU. The filter coefficients hi (k) of all equivalent taps of the individual filters are supplied to one input of the M multipliers MU of a multiplier/summer arrangement MS, whereas the envelope values A1, A2 . . . AM are applied at their second input. As a function of the fact that, in a prescribed time interval, a pulse of the excitation variable X(n) is applied to the control input of a switch, or not so applied, the respective sum function $$\sum_{i=1}^{M} gi(k) \tag{6}$$

is connected to the sum line 1 and, by so doing, the output signal Y(n) is obtained at the output of the synthesizer ST'.

Figure 5:
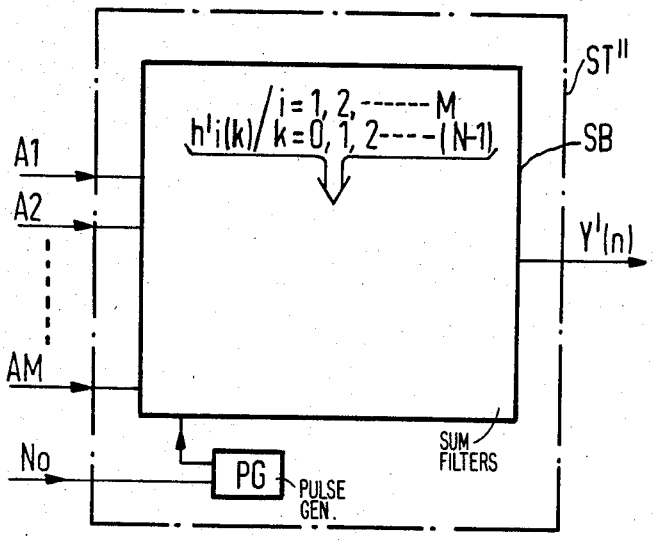
FIG. 5 is a schematic representation of a further embodiment of a synthesizer constructed in accordance with the present invention.

As further investigations underlying the invention have shown, the transmission of the voiceless/voiced signal Sc as well as the random generator PNG can be eliminated in an extremely advantageous manner given such a synthesizer with time-variant FIR filters with a suitable dimensioning of the filter coefficients determining the pulse response or, respectively, the noise response. This is schematically illustrated in FIG. 5. The filter coefficients h' i (k) of the band pass filters B1', B2', . . . BM' or, respectively, of the filter areas of the sum filter SB, are dimensioned with mean frequencies <2 kHz for pulse responses and those of the band pass filters or, respectively, of the filter areas of the sum filter are dimensioned with mean frequencies >2 kHz for noise responses. However, it is also possible in an extraordinarily advantageous manner to dimension all filter coefficients h'i (n) of the band pass filters or, respectively, of the sum filters for noise responses in a suitable manner.

Although I have described my invention by reference to particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A speech synthesizer for receiving and converting digital sum signals transmitted in successive frames into speech, each digital sum signal comprising a plurality of envelope value signals of speech for a plurality of spectral channels which differ as a result of frequency position and width and at least one parameter value signal of a speech-associated parameter assigned to a respective channel, said synthesizer comprising:

dividing means for dividing the digital sum signal into its envelope and parameter value signals;

pulse generating means connected to said dividing means to receive a parameter value signal and operable to produce pulses as excitation pulses; and a time-variant finite pulse response filter bank connected to said pulse generating means to receive excitation pulses and to said dividing means to receive said envelope value signals, said filter bank including coefficient inputs to receive filter bank weighting coefficients and multiplication means for multiplying said coefficients with the envelope values in the rhythm of the successive frames, said filter bank comprising a plurality of multipliers each including a first input means connected to receive a respective envelope value signal, a second input means connected to receive a weighting coefficient and output means, an output line constituting the filter bank output, an excitation line having a maximum of N taps, said excitation line connected to said pulse generating means, a plurality of N−1 time delay circuits separately interposed in said excitation line between the first and the N−1 tap, and a plurality of switches each connected between a respective multiplier output means and said output line, and each comprising a control input connected to a respective tap, whereby the totality of the filter coefficients fix the filter response.

2. A speech synthesizer for receiving and converting digital sum signals transmitted in successive frames into speech, each digital sum signal comprising a plurality of envelope value signals of speech for a plurality of spectral channels which differ as a result of frequency position and width and at least one parameter value signal of a speech-associated parameter assigned to a respective channel, said synthesizer comprising:

dividing means for dividing the digital sum signal into its envelope and parameter value signals;

pulse generating means connected to said dividing means to receive a parameter value signal and operable to produce pulses as excitation pulses; and a time-variant finite pulse response filter bank connected to said pulse generating means to receive excitation pulses and to said dividing means to receive said envelope value signals, said filter bank including coefficient inputs to receive filter bank weighting coefficients and multiplication means for multiplying said coefficients with the envelope values in the rhythm of the successive frames, said filter bank comprising an iterative network of N−1 time delay circuits including a maximum of N taps, a plurality of multiplier/summer circuits each including respective ones of said coefficient inputs, respective inputs for receiving said envelope value signals and a respective output, an output line, and a plurality of switches each connected between a respective multiplier/summer circuit and said output line and each including a control input connected to a respective tap.

3. The speech synthesizer of claim 1, wherein: each of said time delay circuits comprises a shift unit.

4. The speech synthesizer of claim 2, wherein: each of said time delay circuits comprises a shift unit.

* * * * *